US010774398B2

(12) United States Patent
Kuwayama

(10) Patent No.: US 10,774,398 B2
(45) Date of Patent: Sep. 15, 2020

(54) FAR-INFRARED RADIATION MULTI-STAGE TYPE HEATING FURNACE FOR STEEL SHEETS FOR HOT STAMPING

(71) Applicants: NIPPON STEEL & SUMIKIN TEXENG. CO., LTD., Tokyo (JP); SHOWA MANUFACTURING CO., LTD., Fukuoka-shi, Fukuoka (JP)

(72) Inventor: Shinjiro Kuwayama, Tokyo (JP)

(73) Assignees: NIPPON STEEL & SUMIKIN TEXENG, CO., LTD., Tokyo (JP); SHOWA MANUFACTURING CO., LTD., Fukuoka-Shi (JP)

( * ) Notice: Subject to any disclaimer, the term of this patent is extended or adjusted under 35 U.S.C. 154(b) by 821 days.

(21) Appl. No.: 15/316,266

(22) PCT Filed: May 28, 2015

(86) PCT No.: PCT/JP2015/065409
§ 371 (c)(1),
(2) Date: Dec. 5, 2016

(87) PCT Pub. No.: WO2015/186599
PCT Pub. Date: Dec. 10, 2015

(65) Prior Publication Data

US 2017/0159150 A1 Jun. 8, 2017

(30) Foreign Application Priority Data

Jun. 6, 2014 (JP) ..... 2014-117876

(51) Int. Cl.
*C21D 9/46* (2006.01)
*C21D 1/34* (2006.01)
(Continued)

(52) U.S. Cl.
CPC ..... *C21D 9/46* (2013.01); *B21D 22/022* (2013.01); *B21D 37/16* (2013.01); *C21D 1/00* (2013.01);
(Continued)

(58) Field of Classification Search
CPC ... C21D 9/46; C21D 9/00; C21D 1/00; C21D 1/34; B21D 22/022; B21D 37/16;
(Continued)

(56) References Cited

U.S. PATENT DOCUMENTS

2007/0257407 A1 11/2007 Danger et al.
2013/0216969 A1* 8/2013 Schwartz ..... C21D 9/46 432/207
2014/0099590 A1* 4/2014 Hayashi ..... F27B 9/021 432/128

FOREIGN PATENT DOCUMENTS

DE 102010043229 A1 5/2012
JP 3056522 U 2/1999
(Continued)

OTHER PUBLICATIONS

Machine translation of JP 2014-034689 performed on Jul. 12, 2019.*
(Continued)

*Primary Examiner* — Tu B Hoang
*Assistant Examiner* — Alba T Rosario-Aponte
(74) *Attorney, Agent, or Firm* — Birch, Stewart, Kolasch & Birch, LLP

(57) ABSTRACT

A far-infrared radiation multi-stage type heating furnace for steel sheets for hot stamping, the furnace including far-infrared radiation heaters having flexibility that are prevented from deflecting even during heating at temperatures ranging from the $Ac_3$ transformation temperature to 950° C. The furnace includes: multiple-staged heating units that
(Continued)

accommodate steel sheets, each heating unit formed by thermal insulation materials disposed around the periphery; and far-infrared radiation heaters positioned above and below the heating units. A far-infrared radiation heater is received by first metal strips. The first metal strips are disposed so that their strong axis direction approximately corresponds to the direction of gravity and supported by support pieces so as to be expandable and contractible in a longitudinal direction by thermal expansion or thermal contraction. The support pieces are disposed outside the thermal insulation materials in the heating units and a ceiling unit.

17 Claims, 7 Drawing Sheets

(51) Int. Cl.

| | |
|---|---|
| ***C21D 9/00*** | (2006.01) |
| ***C21D 1/00*** | (2006.01) |
| ***H05B 3/62*** | (2006.01) |
| ***B21D 22/02*** | (2006.01) |
| ***H05B 3/00*** | (2006.01) |
| ***H05B 3/06*** | (2006.01) |
| ***H05B 3/66*** | (2006.01) |
| ***F27B 17/00*** | (2006.01) |
| ***B21D 37/16*** | (2006.01) |
| ***F27D 11/12*** | (2006.01) |

(52) U.S. Cl.
CPC ..... *C21D 1/34* (2013.01); *C21D 9/00* (2013.01); *F27B 17/0016* (2013.01); *F27D 11/12* (2013.01); *H05B 3/009* (2013.01); *H05B 3/0061* (2013.01); *H05B 3/06* (2013.01); *H05B 3/62* (2013.01); *H05B 3/66* (2013.01)

(58) Field of Classification Search
CPC ... F27B 17/0016; F27D 11/12; H05B 3/0061; H05B 3/009; H05B 3/06; H05B 3/62; H05B 3/66
USPC ..... 392/411
See application file for complete search history.

(56) References Cited

FOREIGN PATENT DOCUMENTS

| | | | | |
|---|---|---|---|---|
| JP | 2002-221394 | A | | 8/2002 |
| JP | 2007-298270 | A | | 11/2007 |
| JP | 2008-291284 | A | | 12/2008 |
| JP | 2008-296237 | A | | 12/2008 |
| JP | 5197859 | B1 | | 5/2013 |
| JP | 2014-34689 | A | | 2/2014 |
| JP | 2014034689 | A | * | 2/2014 |

OTHER PUBLICATIONS

International Search Report, issued in PCT/JP2015/065409, dated Aug. 18, 2015.
Written Opinion of the International Searching Authority, issued in PCT/JP2015/065409, dated Aug. 18, 2015.
Extended European Search Report, dated Nov. 8, 2017, for corresponding European Application No. 15803975.0.
European Office Action, dated Aug. 22, 2018, for corresponding European Application No. 15803975.0.
Canadian Office Action and Search Report dated Jan. 12, 2018 for corresponding Canadian Application No. 2,950,880.

* cited by examiner

FAR-INFRARED RADIATION MULTI-STAGE TYPE HEATING FURNACE FOR STEEL SHEETS FOR HOT STAMPING

TECHNICAL FIELD

The present invention relates to far-infrared radiation multi-stage type heating furnace for steel sheets for hot stamping, and in particular to a far-infrared radiation multi-stage type heating furnace for heating steel sheets for hot stamping to a temperature in a predetermined range (e.g., from the $Ac_3$ temperature to 950° C.).

BACKGROUND ART

High strength steel sheets are widely used as a blank for making components of an automobile body in order to achieve both a further improvement in the strength, stiffness, and collision safety of the automobile body and an improvement in the fuel economy resulting from the reduced weight of the body. However, the press-formability of steel sheets decreases with increasing strength. As a result, high strength press-formed articles having a desired shape may not be produced.

In recent years, hot press-forming methods (also referred to as hot stamping methods) have been utilized as methods for press-forming components of an automobile body. In hot press-forming methods, a steel sheet (blank) for hot stamping to be press-formed is heated to a temperature equal to or greater than the $Ac_3$ temperature, and immediately after that, is subjected to forming and rapid cooling by a pressing die to be quenched (also referred to as die quenching). In this manner, high strength press-formed articles having a desired shape are produced.

Production of high strength hot press-formed articles in large volumes by a hot press-forming method requires use of a heating furnace for heating steel sheets for hot stamping. Inventions relating to such heating furnaces have been proposed heretofore.

Patent Document 1 discloses a multi-stage heating furnace. The multi-stage heating furnace includes a plurality of accommodation spaces for accommodating a plurality of steel sheets for hot stamping. The plurality of accommodation spaces are aligned in a vertical direction so as to be horizontal to each other. Means for transferring the steel sheets for hot stamping during heating are provided in the plurality of accommodation spaces.

Patent Document 2 discloses a multi-stage heating furnace that includes a box-shaped body and a heat source. Heating chambers are formed within the body. The heat source heats the insides of the chambers to about 900° C. This multi-stage heating furnace is capable of heating a plurality of steel sheets for hot stamping simultaneously and discharging the heated steel sheets for hot stamping separately.

Patent Document 3 discloses a multi-stage heating furnace that includes a body. Heating chambers to be heated by heat sources are provided within the body. Multiple-staged openings arranged in a vertical direction are provided in the front wall of the body. An opening and closing door is provided for each opening at each stage.

Furthermore, Patent Document 4 discloses a heat treatment method. The heat treatment method includes a first step and a second step. In the first step, a steel sheet for hot stamping is heated to an alloying temperature. In the second step, a first region of the steel sheet for hot stamping is held at a temperature equal to or greater than the $A_3$ transformation temperature utilizing thermal energy imparted in the first step while depriving a second region of the steel sheet for hot stamping of thermal energy. As a result, the second region of the steel sheet for hot stamping cools to a temperature equal to or less than the $A_1$ transformation temperature. This heat treatment method can effectively utilize thermal energy imparted in the alloying process and shorten the time for heat treatment.

The heating furnaces disclosed by Patent Documents 1 to 4 use a gas burner, an electric coil heater, a radiant tube, an electromagnetic heater, or another type of heater as the heat source for steel sheets for hot stamping.

These heating furnaces need to meet the following requirements: rapid and uniform heating of the steel sheet for hot stamping over all regions to a high temperature range of equal to or greater than the $Ac_3$ temperature (e.g., from 850 to 950° C.); an improvement in the ability for mass production; and minimization of the area for installation. In recent years, heating furnaces utilizing a far-infrared radiation heater as its heat source have been increasingly used. Heating furnaces of this type have the characteristics a to c listed below:

(a) capable of uniformly heating a steel sheet for hot stamping;

(b) capable of being compact by virtue of the vertically extending multi-stage configuration; and (c) having a thin planar shape and being capable of heating a steel sheet for hot stamping at both sides thereof.

Patent Document 5 discloses a multi-stage heating furnace using a flexible far-infrared radiation heater as its heat source. The flexible far-infrared radiation heater is constructed of numerous insulators arranged in rows and knitted together to form a flexible panel. The numerous insulators have slits for receiving a resistive heating conductor. A heating conductor that emits far-infrared radiation is inserted and provided in the slits.

LIST OF PRIOR ART DOCUMENTS

Patent Document

Patent Document 1: JP2007-298270A
Patent Document 2: JP2008-291284A
Patent Document 3: JP2008-296237A
Patent Document 4: JP5197859B
Patent Document 5: JP2014-34689A

SUMMARY OF INVENTION

Technical Problem

The multi-stage type heating furnace disclosed by Patent Document 5 has the problems A to C listed below. Flexible far-infrared radiation heaters have the properties of being bendable and deflectable (flexibility). When a flexible far-infrared radiation heater disposed within the furnace partially deflects during heating, the problems A to C listed below occur.

(A) The distance between the flexible far-infrared radiation heater and the steel sheet for hot stamping varies from region to region. This results in region-to-region variations in heating of the steel sheet for hot stamping. As a result, it becomes difficult to uniformly heat the steel sheet for hot stamping to a predetermined temperature.

(B) The space for feeding a steel sheet for hot stamping into the furnace and the space for discharging the steel sheet for hot stamping out of the furnace become partially narrowed.

As a result, the steel sheet for hot stamping, when being fed into or discharged out of the furnace, may come into contact with the heater, which can lead to the occurrence of operational problems or electric shock.

(C) The deflected flexible far-infrared radiation heater results in high repair costs.

Accordingly, it is necessary to support the flexible far-infrared radiation heater in a manner to substantially prevent the flexible far-infrared radiation heater from deflecting even during operation for example at 850° C. or above.

Within heating furnaces for steel sheets for hot stamping, the ambient temperature is high, for example ranging from 850 to 950° C. Thus, even if heater support members formed of an appropriate metal material are used to support the flexible far-infrared radiation heater, there is a concern that the heater support members may deform under thermal stress or high temperature creep strain.

Also, even if heater support members formed of ceramics are used to support the flexible far-infrared radiation heater, there is a concern that the heater support members may break from thermal shock. Furthermore, it is required that the heater support members are small in projected area in order to ensure heating uniformity and temperature controllability.

Thus, when high strength press-formed articles are to be produced in large volumes using a flexible far-infrared radiation heater as the heat source of a heating furnace for steel sheets for hot stamping, it is necessary to suitably configure the heater support members for the flexible far-infrared radiation heater. However, Patent Document 5 does not disclose any heater support members that can support the flexible far-infrared radiation heater in such a manner.

The present invention aims at providing a far-infrared radiation multi-stage type heating furnace for steel sheets for hot stamping capable of solving such problems of the conventional art.

Solution to Problem

The present invention is as set forth below.

(1) A far-infrared radiation multi-stage type heating furnace for steel sheets for hot stamping, the far-infrared radiation multi-stage type heating furnace including heating units, the heating units including: blocks made of a thermal insulation material, the blocks being disposed around horizontal planes of spaces for accommodating the steel sheets for hot stamping; and far-infrared radiation heaters positioned above and below the steel sheets for hot stamping to heat the steel sheets for hot stamping, the far-infrared radiation multi-stage type heating furnace further including: a plurality of first metal strips that receive the far-infrared radiation heaters in such a manner that the far-infrared radiation heaters are disposed approximately horizontally, the first metal strips being aligned in a first direction and disposed so that a strong axis direction thereof approximately corresponds to a direction of gravity; and support pieces that support the plurality of first metal strips in such a manner that the first metal strips are expandable and contractible in a longitudinal direction by thermal expansion or thermal contraction.

(2) The far-infrared radiation multi-stage type heating furnace according to item 1 for steel sheets for hot stamping, wherein the support pieces are positioned outside the blocks in the heating units.

(3) The far-infrared radiation multi-stage type heating furnace according to item 1 or 2 for steel sheets for hot stamping, wherein each of the far-infrared radiation heaters is a planar structure formed of a plurality of insulator elements arranged in rows, the insulator elements being made of sintered form of far-infrared radiation emitting ceramics, and wherein the plurality of insulator elements are coupled together by a heating wire so as to be capable of being displaced from each other so that the far-infrared radiation heater has flexibility, the heating wire being inserted in heating wire through holes formed in the respective insulator elements.

(4) The far-infrared radiation multi-stage type heating furnace according to any one of items 1 to 3 for steel sheets for hot stamping, wherein the first metal strips are made of a heat resistant alloy.

It is desirable that the heat resistant alloy is a material having a low high-temperature creep strain rate.

(5) The far-infrared radiation multi-stage type heating furnace according to any one of items 1 to 4 for steel sheets for hot stamping, wherein the first metal strips receive the far-infrared radiation heaters via an insulating member.

(6) The far-infrared radiation multi-stage type heating furnace according to any one of items 1 to 5 for steel sheets for hot stamping, the far-infrared radiation multi-stage type heating furnace further including a plurality of second metal strips that are aligned in a second direction intersecting the first direction to receive the far-infrared radiation heaters, the plurality of second metal strips being disposed so that a strong axis direction thereof approximately corresponds to the direction of gravity, the second metal strips being supported by the plurality of first metal strips in such a manner that the second metal strips are expandable and contractible in a longitudinal direction by thermal expansion or thermal contraction.

Advantageous Effects of the Invention

The first metal strips of the far-infrared radiation multi-stage type heating furnace according to the present invention are capable of supporting, with their small projected areas, the far-infrared radiation heaters having flexibility in a manner to prevent their deflection even during heating for example at 850° C. or above.

Thus, the far-infrared radiation multi-stage type heating furnace according to the present invention requires less frequent maintenance or repair of its far-infrared radiation heaters, and consequently achieves: a significant reduction in the maintenance cost of the far-infrared radiation multi-stage type heating furnace; an improvement in capacity utilization of the far-infrared radiation multi-stage type heating furnace; retention and improvement of heating uniformity of steel sheets for hot stamping; and size reduction of the far-infrared radiation multi-stage type heating furnace due to its multi-stage configuration.

BRIEF DESCRIPTION OF THE DRAWINGS

FIG. 1(*b*) is a front view of the insulator element; FIG. 1(*c*) is a plan view of the flexible far-infrared radiation heater;

FIG. 1(*d*) is a front view illustrating an array of insulators knitted together to look like a bamboo blind with a heating wire passed therethrough; FIG. 1(*e*) is a side view of FIG. 1(*c*); and FIG. 1(*f*) is an illustration of the insulator elements arranged such that adjacent rows are offset by half the length of the preceding row.

FIG. 3(*a*) is an illustration of the exterior of the far-infrared radiation multi-stage type heating furnace; FIG. 3(*b*) is an illustration of a heating unit; FIG. 3(*c*) is a cross-sectional view taken along the line A-A of FIG. 3(*b*); FIG. 3(*d*) is an illustration of the heating unit with its cover block removed; FIG. 3(*e*) is a cross-sectional view taken along the line B-B of FIG. 3(*b*); and FIG. 3(*f*) is a perspective view of a steel sheet support member.

FIG. 6(*b*) is a top view of the heating unit; FIG. 6(*c*) is an illustration depicting a positional relationship between the heater and the steel sheet for hot stamping; and FIG. 6(*d*) is an illustration of an alternative heater support member in a heating unit.

FIG. 7(*b*) is a cross-sectional view of the steel sheet support member; and FIGS. 7(*c*) to 7(*f*) are each an illustration of an alternative example.

DESCRIPTION OF EMBODIMENTS

The present invention will be described with reference to the accompanying drawings.

1. Configuration of Furnace Body Frame 12

Figure 2:
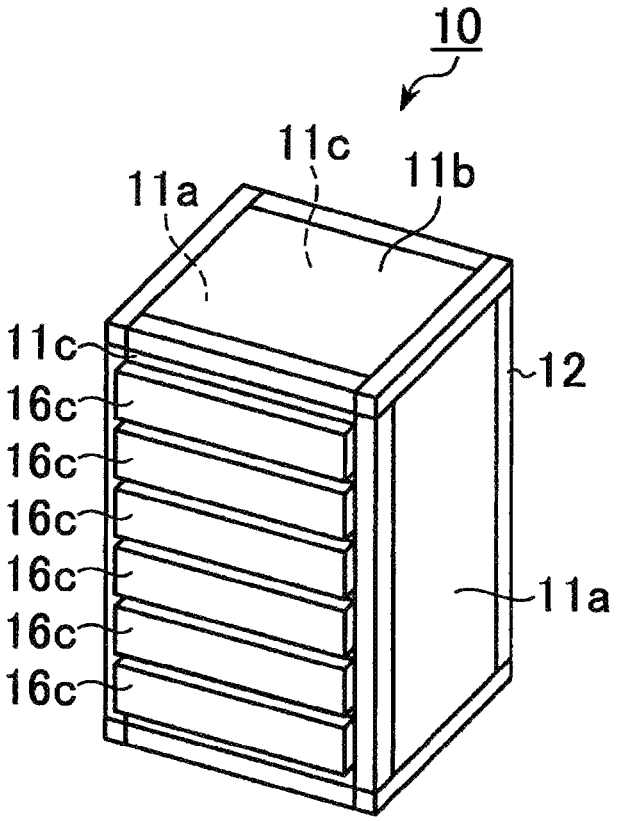
FIG. 2 is an overall view of a far-infrared radiation multi-stage type heating furnace according to the present invention.

FIG. 2 is an overall view of a far-infrared radiation multi-stage type heating furnace 10 according to the present invention, illustrating exterior panels 11*a*, 11*b*, 11*c* and a furnace body frame 12.

Figure 3:
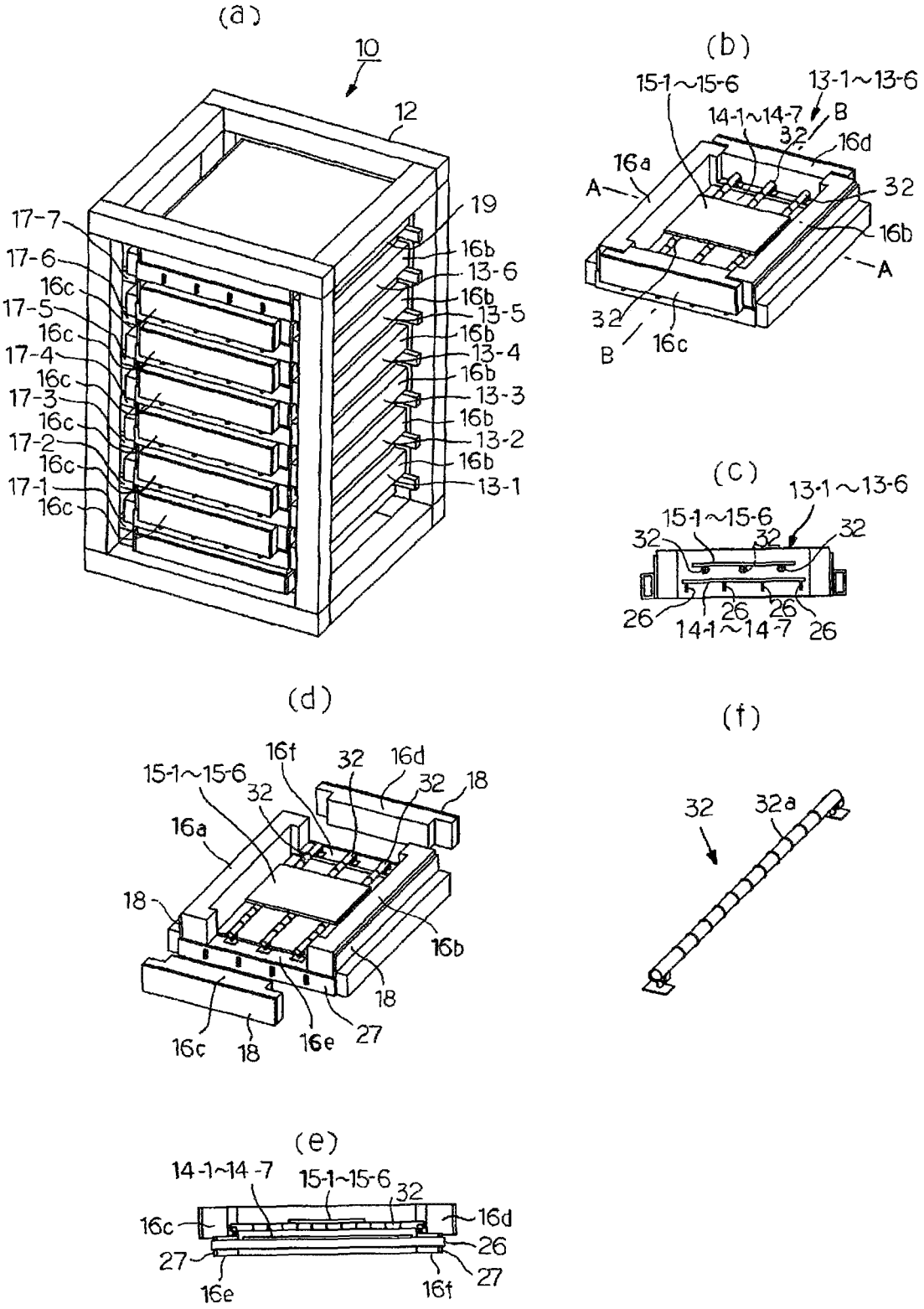
FIG. 3 presents illustrations of the far-infrared radiation multi-stage type heating furnace according to the present invention.

FIG. 3 presents illustrations of the far-infrared radiation multi-stage type heating furnace 10 according to the present invention. FIG. 3(*a*) is an illustration of the exterior of the far-infrared radiation multi-stage type heating furnace 10, FIG. 3(*b*) is an illustration of heating units 13-1 to 13-6, FIG. 3(*c*) is a cross-sectional view taken along the line A-A of FIG. 3(*b*), FIG. 3(*d*) is an illustration of the heating units 13-1 to 13-6 with the cover blocks 16*c*, 16*d* removed, FIG. 3(*e*) is a cross-sectional view taken along the line B-B of FIG. 3(*b*), and FIG. 3(*f*) is a perspective view of a steel sheet support member 32.

Figure 4:
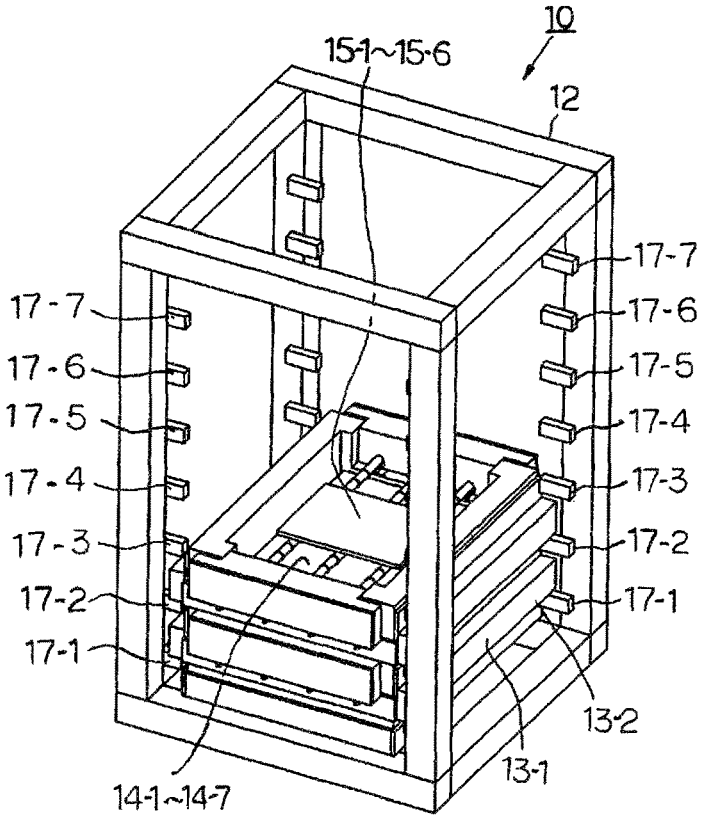
FIG. 4 is an illustration of the far-infrared radiation multi-stage type heating furnace.
Figure 5:
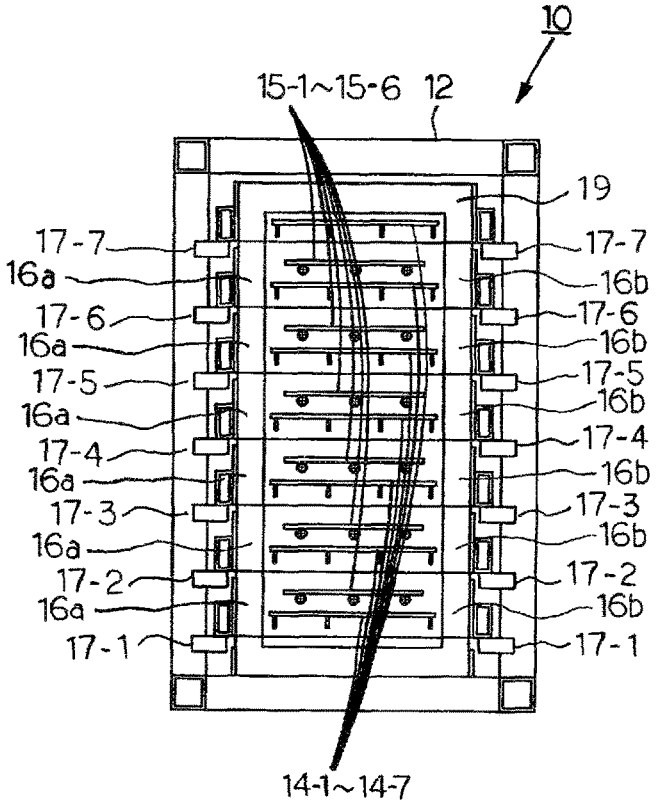
FIG. 5 is a front view of the far-infrared radiation multi-stage type heating furnace with a ceiling unit illustrated therein.

FIG. 4 is an illustration of the far-infrared radiation multi-stage type heating furnace 10 with only the heating units 13-1, 13-2 illustrated therein. FIG. 5 is a front view of the far-infrared radiation multi-stage type heating furnace 10 with a ceiling unit 19 illustrated therein.

As illustrated in FIGS. 2 to 5, the far-infrared radiation multi-stage type heating furnace 10 includes heating units 13-1 to 13-6, the ceiling unit 19, and the furnace body frame 12.

The heating units 13-1 to 13-6 each have a space for accommodating steel sheets for hot stamping 15-1 to 15-6, respectively. The space is formed by blocks 16*a*, 16*b*, 16*c*, 16*d*, 16*e*, 16*f* made of a thermal insulation material that are disposed around the space. The heating units 13-1 to 13-6 respectively accommodate steel sheets for hot stamping 15-1 to 15-6 supported approximately horizontally within the spaces.

The heating units 13-1 to 13-6 are a plurality of (six in the case of the far-infrared radiation multi-stage type heating furnace 10 illustrated in FIGS. 2 to 5) heating units that are stacked in a vertical direction.

The heating units 13-1 to 13-6 include far-infrared radiation heaters 14-1 to 14-6, respectively, and the ceiling unit 19 includes a far-infrared radiation heater 14-7. The far-infrared radiation heaters 14-1 to 14-7 are positioned above and below the steel sheets for hot stamping 15-1 to 15-6 accommodated in the spaces. Specifically, the far-infrared radiation heaters 14-1, 14-2 are respectively positioned above and below the steel sheet for hot stamping 15-1, the far-infrared radiation heaters 14-2, 14-3 are respectively positioned above and below the steel sheet for hot stamping 15-2, the far-infrared radiation heaters 14-3, 14-4 are respectively positioned above and below the steel sheet for hot stamping 15-3, the far-infrared radiation heaters 14-4, 14-5 are respectively positioned above and below the steel sheet for hot stamping 15-4, the far-infrared radiation heaters 14-5, 14-6 are respectively positioned above and below the steel sheet for hot stamping 15-5, and the far-infrared radiation heaters 14-6, 14-7 are respectively positioned above and below the steel sheet for hot stamping 15-6.

Thus, the far-infrared radiation heaters 14-1 to 14-7 heat corresponding ones of the steel sheets for hot stamping 15-1 to 15-6 from above and below to a temperature ranging from the $Ac_3$ transformation temperature to 950° C. for example.

The far-infrared radiation heaters 14-1 to 14-7 are flexible planar far-infrared radiation heaters (hereinafter also referred to as "flexible far-infrared radiation heater") as disclosed in Japanese Registered Utility Model Publication No. 3056522.

Figure 1:
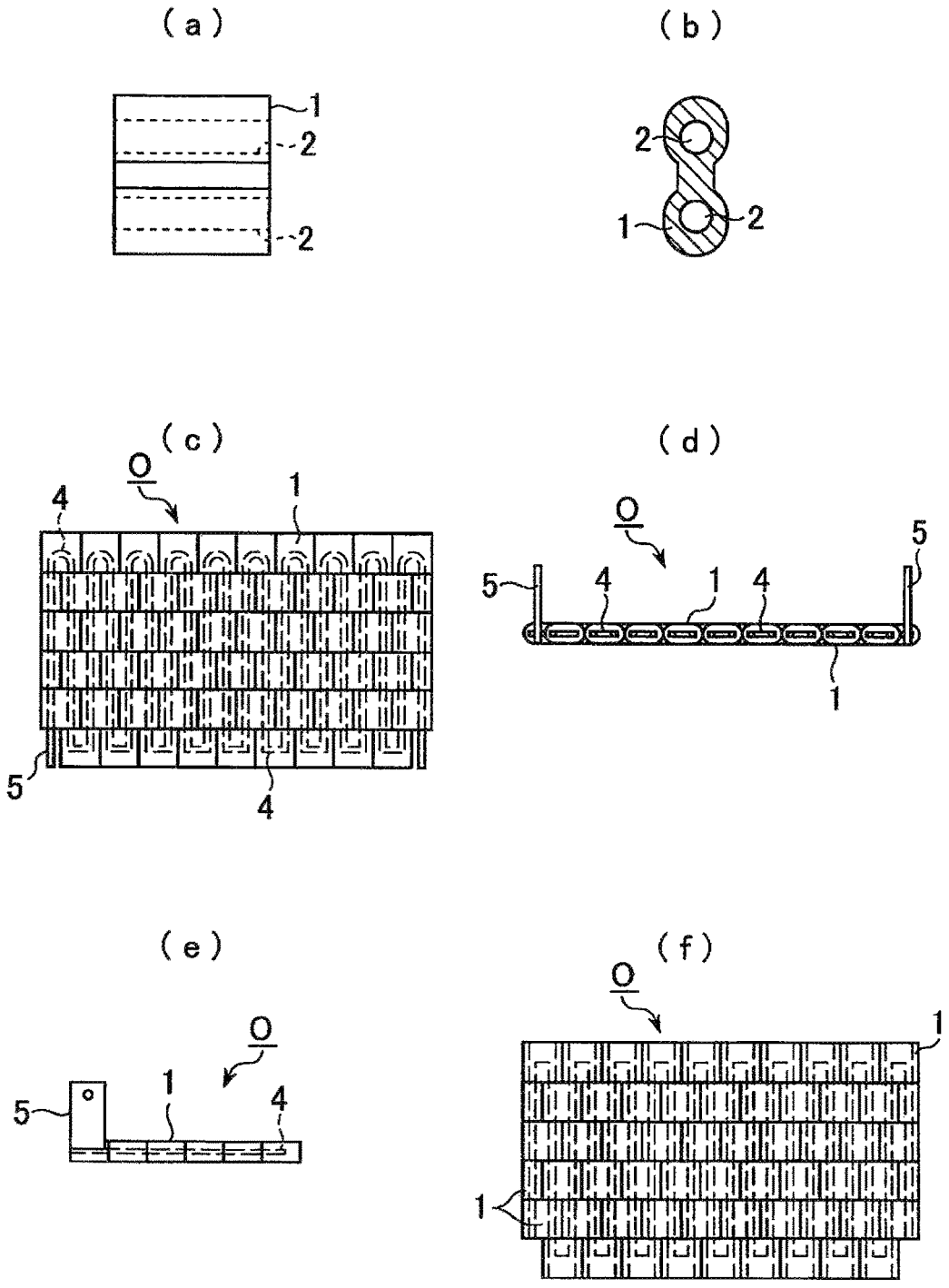
FIG. 1(*a*) is a plan view of an insulator element used in a flexible far-infrared radiation heater.

The far-infrared radiation heaters 14-1 to 14-7 includes insulator elements 1 as illustrated in FIGS. 1(*a*) to 1(*f*). The insulator elements 1 are made of sintered form of far-infrared radiation emitting ceramics such as for example $Al_2O_3$, $SiO_2$, $ZrO_2$, $TiO_2$, SiC, CoO, $Si_3N_4$. The far-infrared radiation heaters 14-1 to 14-7 are each a planar structure formed of a plurality of insulator elements 1 arranged in rows. The plurality of insulator elements 1 are coupled together so as to be capable of being displaced from each other by a heating wire 4 inserted in heating wire through holes 2 formed in the respective insulator elements 1. The far-infrared radiation heaters 14-1 to 14-7 are flexible far-infrared radiation heaters having flexibility.

The far-infrared radiation heaters 14-1 to 14-7 generate heat from the inside of the insulator elements 1 upon application of current through the heating wire provided within the insulator elements 1. As a result, a high rate of temperature increase is achieved in the far-infrared radiation heaters 14-1 to 14-7. The far-infrared radiation heaters 14-1 to 14-7 are capable of performing heating at both sides thereof and therefore achieve reduced heat loss. The far-infrared radiation heaters 14-1 to 14-7 emit high-density far-infrared radiation energy and therefore provide for enhanced heating efficiency. The far-infrared radiation heaters 14-1 to 14-7 are flexible, and therefore are less likely to have cracks or deformation at high temperatures and the size thereof can be easily set ranging from a small size to a large size. In addition, the far-infrared radiation heaters 14-1 to 14-7 are thin, and further, capable of heating both sides of the steel sheets for hot stamping 15-1 to 15-6.

Hence, the far-infrared radiation heaters 14-1 to 14-7 are preferable as heaters that are respectively provided in the heating units 13-1 to 13-6 and ceiling unit 19 of the multi-stage heating furnace and required to exhibit high heating efficiency and excellent furnace temperature controllability.

The furnace body frame 12 is a frame made of metal (carbon steel for example) disposed so as to surround the heating units 13-1 to 13-6 and the ceiling unit 19.

As illustrated in FIG. 3(*b*), the spaces of the heating units 13-1 to 13-6 each have an approximately rectangular outer shape in a horizontal plane. The heating units 13-1 to 13-6 each include blocks 16*a*, 16*b*, 16*c*, 16*d*, 16*e*, 16*f* made of a thermal insulation material that surround the periphery of each space in a horizontal plane.

The heating units 13-1 to 13-6 are each constituted by fixed blocks 16*a*, 16*b*, fixed blocks 16*e*, 16*f*, and cover blocks 16*c*, 16*d*. The fixed blocks 16*a*, 16*b* are fixedly placed at two opposing sides of the rectangular shape. The fixed blocks 16*a*, 16*b* have an approximately rectangular solid outer shape. The fixed blocks 16*e*, 16*f* are fixedly placed at the remaining two opposing sides. The fixed blocks 16*e*, 16*f* have an approximately rectangular solid outer shape. The cover blocks 16*c*, 16*d* are disposed to engage with the fixed blocks 16*e*, 16*f* so as to be openable and closable.

Opening and closing of the cover blocks 16*c*, 16*d* is actuated by a suitable opening and closing mechanism (not illustrated). In a closed state the cover blocks 16*c*, 16*d* are in contact with the front faces, upper faces, and lower faces of the fixed blocks 16*e*, 16*f* and end faces in the longitudinal direction of the fixed blocks 16*a*, 16*b*. In this manner, the cover blocks 16*c*, 16*d*, together with the fixed blocks 16*a*, 16*b* and the fixed blocks 16*e*, 16*f* thermally insulate the internal spaces of the heating units 13-1 to 13-6 from the outside.

The heating units 13-1 to 13-6 each include metal (steel for example) furnace shells (iron shells) 18, which surround peripheries of the fixed blocks 16*a*, 16*b* and fixed blocks 16*e*, 16*f* and retain the fixed blocks 16*a*, 16*b* and fixed blocks 16*e*, 16*f*.

Spacers 17-1 to 17-7 made from steel for example are mounted at heights that conform to the placement heights of the heating units 13-1 to 13-6 and ceiling unit 19 in the furnace body frame 12 by suitable means such as for example welding or fastening. It suffices if the spacers 17-1 to 17-7 exhibit heat resistance to a degree sufficient to avoid deformation that may be caused by heat transmitted from the fixed blocks 16*a*, 16*b*, and thus the spacers may be formed from a metal material other than steel.

The fixed blocks 16*a*, 16*b* of the heating units 13-1 to 13-6 and ceiling unit 19 are supported (received) by the spacers 17-1 to 17-7 interposed between them and the furnace body frame 12. The fixed blocks 16*a*, 16*b* are in contact with the spacers 17-1 to 17-7 but not in contact with the furnace body frame 12.

As described above, the heating units 13-1 to 13-6 and ceiling unit 19, which have the spaces in which the ambient temperature reaches 850 to 950° C. during operation, contact the spacers 17-1 to 17-7 but do not contact the furnace body frame 12. As a result, the heat of the heating units 13-1 to 13-6 and ceiling unit 19 does not transfer to the furnace body frame 12. Consequently, thermal expansion of the furnace body frame 12 is prevented.

For example, the amount of displacement of the furnace body frame 12 at the height at the center in the height direction of the uppermost heating unit 13-6 during operation of the far-infrared radiation multi-stage type heating furnace 10 is approximately 0.4 to 0.5 mm. Thus, deformation of the furnace body frame 12 due to thermal expansion is substantially eliminated.

As a result, the furnace body frame 12 is free of thermal stress, and deformation of the furnace body frame 12 due to thermal expansion or thermal contraction, repetitive thermal stress loading, unstable operation, shortened life of the refractories that are the thermal insulation materials 16 and also damages such as cracking of the furnace body frame 12 are prevented. This results in a significant reduction in the maintenance cost and an improvement in capacity utilization of the far-infrared radiation multi-stage type heating furnace 10.

2. Support Members 24-1, 24-2 for Far-Infrared Radiation Heater 14-1

Figure 6:
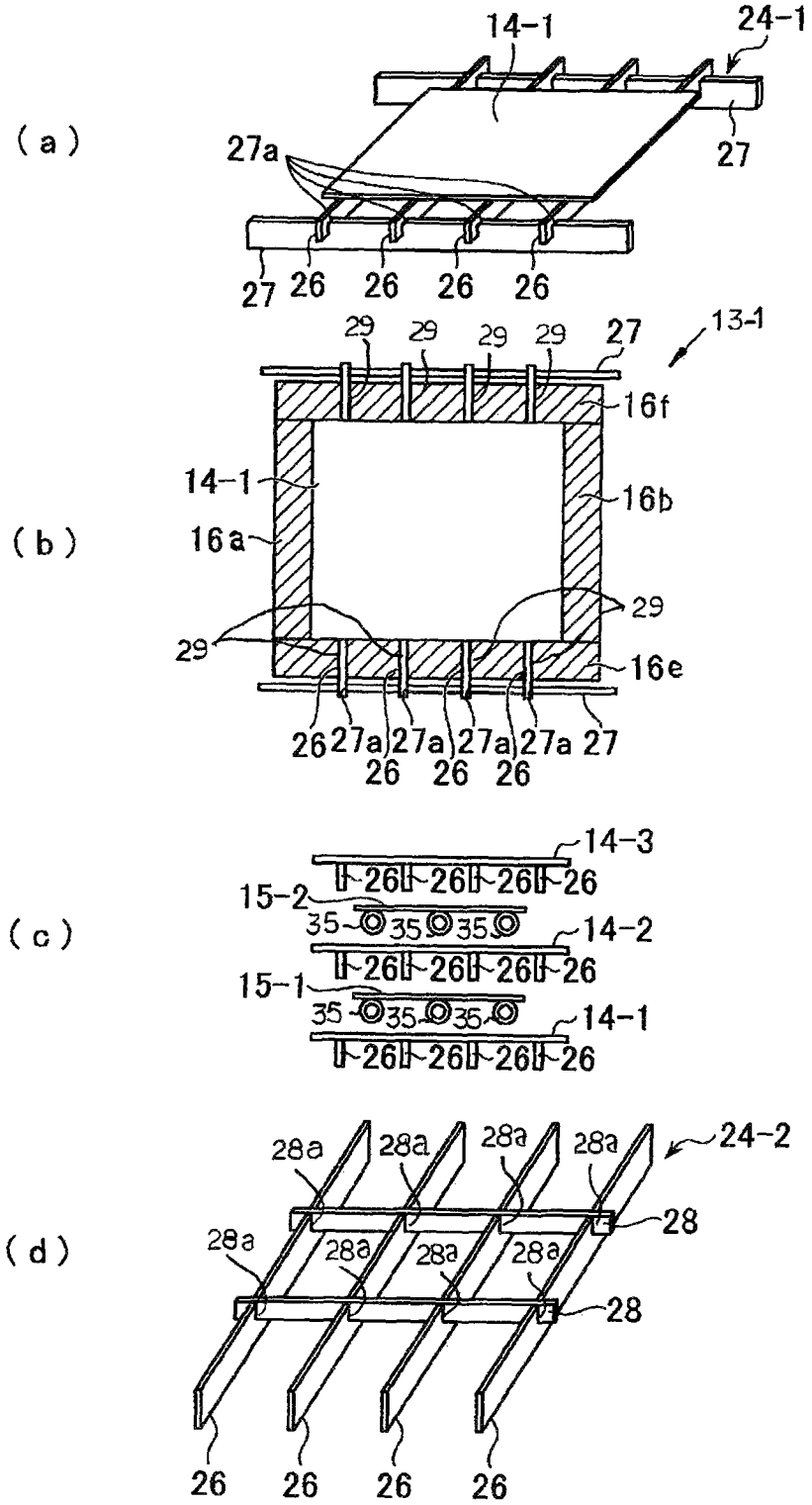
FIG. 6(*a*) is an illustration of a heater support member in a heating unit.

FIG. 6(*a*) is an illustration of a heater support member (hereinafter simply referred to as "support member") 24-1 for the far-infrared radiation heater 14-1 in the heating unit 13-1; FIG. 6(*b*) is a top view of the heating unit 13-1; FIG. 6(*c*) is an illustration depicting a positional relationship between the far-infrared radiation heater 14-1 and the steel sheet for hot stamping 15-1; and FIG. 6(*d*) is an illustration of an alternative support member 24-2 for the far-infrared radiation heater 14-1 in the heating unit 13-1.

As illustrated in FIGS. 6(*a*) to 6(*c*), the far-infrared radiation heater 14-1 is supported by the support member 24-1 horizontally in a manner to prevent deflection. The support member 24-1 is made up of first metal strips 26 and support pieces 27. The first metal strip 26 is formed from a nickel-based heat resistant alloy for example. A plurality of (four in FIGS. 6(*a*) to 6(*d*)) the first metal strips 26 are provided in alignment in a first direction. The support pieces 27 support the first metal strips 26. The support pieces 27 are plates formed of a stainless steel for example.

As illustrated in FIG. 6(*b*), the far-infrared radiation heater 14-1 is received by the four first metal strips 26 to be disposed approximately horizontally. The far-infrared radiation heater 14-1 is disposed within the region surrounded by the fixed blocks 16*a*, 16*b*, 16*e*, 16*f* in a horizontal plane.

The four first metal strips 26 are all provided such that their strong axis direction (direction in which the flexural rigidity (area moment of inertia and section modulus) is greater) approximately corresponds to the direction of gravity. This minimizes deflection of the first metal strips 26.

The first metal strips 26 are fitted into respective slits or holes 27*a* (slits are illustrated in the figure) formed in the support pieces 27 so as to provide clearance in the slits or holes, and are supported. This configuration allows the first metal strips 26 to be supported by the support pieces 27 so as to be expandable and contractible in a longitudinal direction by thermal expansion or thermal contraction. As a result, the first metal strips 26 are free of thermal stress caused by temperature changes.

Figure 8:
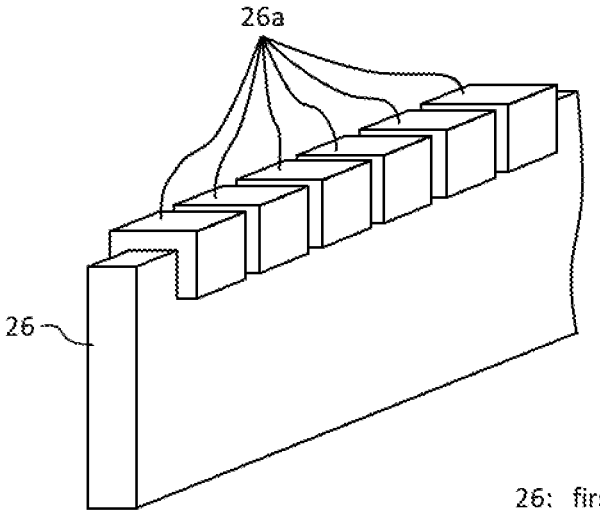
FIG. 8 is an illustration of an exemplary metal strip with insulating member.

Preferably, the first metal strips 26 receive the far-infrared radiation heater 14-1 via an insulating member (made of $Al_2O_3$ for example) having thermally insulating properties and insulating properties. An example of such insulating member is one having a cross sectional shape with a groove and which is attached to the first metal strip 26 by being fitted into the upper end of the first metal strip 26. As illustrated in FIG. 8.

FIG. 6(*d*) illustrates an alternative support member 24-2, which may be constituted by a plurality of (two in FIG. 6(*d*)) second metal strips 28 together with the first metal strips 26. The plurality of second metal strips 28 are provided in alignment in a second direction intersecting (orthogonal in the illustrated example) the first direction in which the first metal strips 26 are oriented. The second metal strips 28 are formed of a stainless steel for example.

Similarly to the first metal strips 26, the second metal strips 28 are provided such that their strong axis direction approximately corresponds to the direction of gravity. The second metal strips 28 are fitted into respective slits 28*a* formed in the first metal strips 26 so as to provide clearance in the slits, and are supported. This configuration allows the second metal strips 28 to be supported by the first metal strips 26 so as to be expandable and contractible in a longitudinal direction by thermal expansion or thermal contraction. As a result, the second metal strips 28 are free of thermal stress caused by temperature changes.

As illustrated in FIG. 6(*b*), through holes 29 are formed in the thermal insulation materials 16*e*, 16*f*. The first metal strips 26 pass through the through holes 29 of the thermal insulation materials 16*e*, 16*f* and are supported by the support pieces 27. The support pieces 27 are located outside the steel sheet accommodating regions surrounded by the fixed blocks 16*a*, 16*b*, 16*e*, 16*f*, which are the thermal insulation materials. The outer portions of the first metal strips 26 protruding from the thermal insulation materials 16*e*, 16*f* become hot and therefore preferably a thermal insulation process is applied to the outer portions of the first metal strips 26 by enclosing them with thermal insulation materials or covers for example.

As described above, outside the thermal insulation materials 16*a*, 16*b*, 16*e*, 16*f*, the support pieces 27 support the plurality of first metal strips 26 or the plurality of first metal strips 26 and plurality of second metal strips 28.

The first metal strips 26 (1000 mm in overall length) formed from Inconel (registered trademark) were placed at predetermined locations in the heating unit 13-1 of the far-infrared radiation multi-stage type heating furnace 10 in the manner described above, and the far-infrared radiation multi-stage type heating furnace 10 was used 24 hours a day for one month. The result was that the amount of vertically downward deflection at the longitudinal center of the first metal strips 26 was less than 0.1 mm. This demonstrates that the first metal strips 26 are able to support the far-infrared radiation heater 14-1 sufficiently flatly without causing deflection.

As described above, the support members 24-1, 24-2 are capable of supporting the far-infrared radiation heater 14-1 without causing deflection despite their small projected areas, by means of the first metal strips 26 or by means of the first metal strips 26 and the second metal strips 28, even during heating at 850° C. or above.

Thus, the present invention reduces the frequency or number of times of maintenance of the far-infrared radiation heater 14-1 having flexibility, and thereby achieves all of the following: a significant reduction in the maintenance cost of the far-infrared radiation multi-stage type heating furnace 10; an improvement in capacity utilization of the far-infrared radiation multi-stage type heating furnace 10; retention and improvement of heating uniformity of steel sheets for hot stamping 15-1; and size reduction of the far-infrared radiation multi-stage type heating furnace 10 due to its multi-stage configuration.

In the exemplary embodiment illustrated in FIG. 6(*c*), the steel sheet for hot stamping 15-1 is supported by round tubes 35 in line contact. However, the present invention is not limited to this embodiment. For example, the steel sheet for hot stamping 15-1 may be supported by a variety of below-described steel sheet support members 31 to 34 illustrated in FIGS. 7(*a*) to 7(*f*).

3. Steel Sheet Support Members 30 to 34 for Steel Sheet for Hot Stamping 15-1

Figure 7:
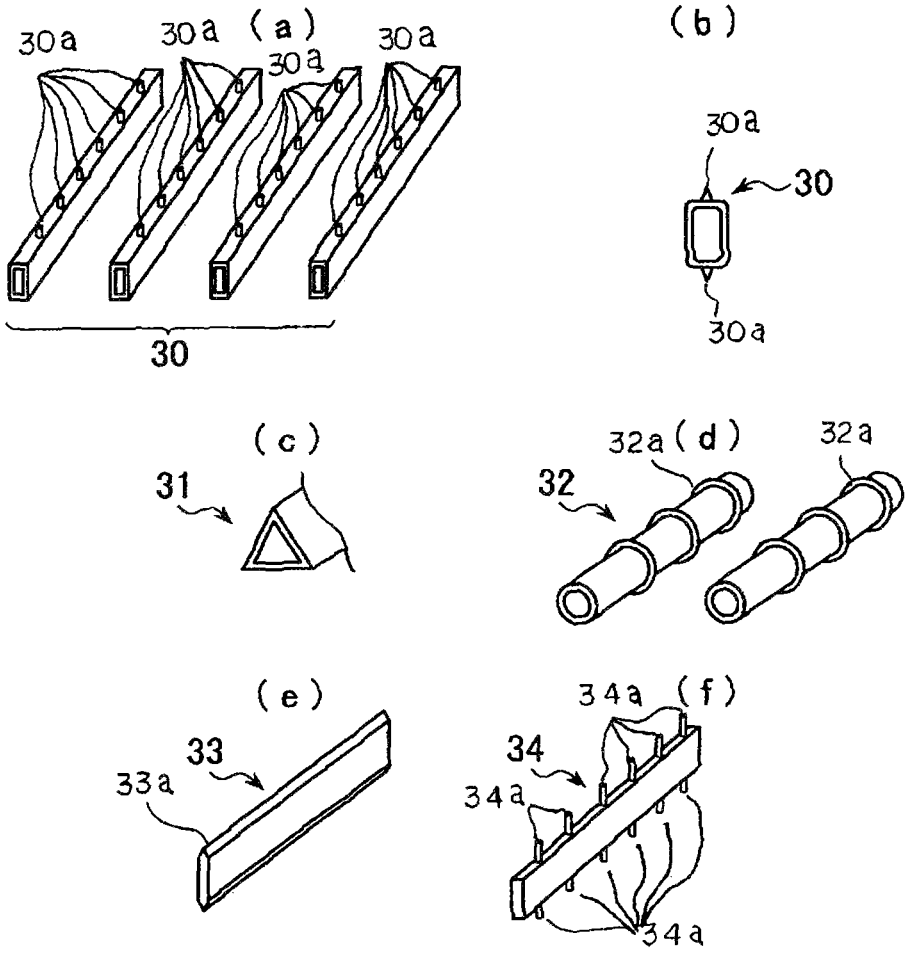
FIG. 7(*a*) is an illustration of an exemplary steel sheet support member.

FIG. 7(*a*) is an illustration of an exemplary steel sheet support member 30; FIG. 7(*b*) is a cross-sectional view of the steel sheet support member 30; and FIGS. 7(*c*) to 7(*f*) are illustrations of alternative exemplary steel sheet support members 31 to 34.

For example, any of the steel sheet support members 30 to 34 each made of a heat resistant alloy can be mounted to the heating unit 13-1 of the far-infrared radiation multi-stage type heating furnace 10. The steel sheet support members 30 to 34 support the steel sheet for hot stamping 15-1 by point contact or by line contact with the steel sheet for hot stamping 15-1.

In the present invention, "point contact" refers to contact by a contact surface, for example of a pin, formed on its front edge and having an outside diameter of approximately 6 mm or less, or contact by the outer circumferential surface for example of a ring having a cross-sectional diameter of approximately 7 mm or less, and "line contact" refers to contact by a contact surface, for example of a plate, formed on its edge by beveling or other means and having a width of approximately 3 mm or less, contact by the outer circumferential surface of a steel bar having an outside diameter of approximately 6 mm or less, or contact by the outer circumferential surface for example of a thin-wall round tube having an outside diameter of approximately of 20 mm or less. By virtue of the point contact or line contact, dispersion of a coating at the contact region is prevented in the case where the steel sheet for hot stamping is a zinc-coated steel sheet.

Examples of steel sheet support members that provide a point contact with the steel sheet for hot stamping 15-1 include: a rectangular tube 30 in a laterally vertical position having upright pins 30*a* provided on its surface (see FIGS. 7(*a*) and 7(*b*)); a rectangular bar 34 in a laterally vertical position having upright pins 34*a* provided on its surface (see FIG. 7(*f*)); or a round tube 32 having, on its outer circumferential surface, a wire 32*a* of a circular cross section wound therearound (see FIG. 7(*d*)). In these instances, it is preferred that the bodies of the rectangular tube 30 and the rectangular bar 34 are made of a super heat resistant alloy such as Inconel for example and that the pins 30*a*, 34*a* provided on the bodies of the rectangular tube 30 and the rectangular bar 34, respectively, are made of ceramics (e.g., $Al_2O_3$, $SiO_2$, $ZrO_2$, $TiO_2$, SiC, CoO, $Si_3N_4$), which are non-metallic materials, in order to ensure the quality of the steel sheet for hot stamping.

Examples of steel sheet support members that provide a line contact with the steel sheet for hot stamping 15-1 include: a triangular tube 31 having an equilateral triangular cross section (see FIG. 7(*c*)); and a plate member 33 in a laterally vertical position having an acute angle portion 33*a* disposed on its surface (see FIG. 7(*e*)).

Similarly to the first metal strips 26 and the second metal strips 28, it is preferred that the steel sheet support members 30 to 34 are supported by the support pieces so as to be expandable and contractible in a longitudinal direction by thermal expansion or thermal contraction in order to prevent thermal stress caused by temperature change. For example, the steel sheet support members 30 to 34 are supported by support pieces mounted to the upper surfaces of the thermal insulation materials 16*e*, 16*f* so as to be expandable and contractible in a longitudinal direction by thermal expansion or thermal contraction.

If the steel sheet support members 30 to 34 have been deflected in use, they may be turned upside down and relocated so as to project upwardly.

The rectangular tubes 30 formed from Inconel having a cross-sectional shape as illustrated in FIG. 7(*b*) (800 mm in overall length) were placed as steel sheet support members at predetermined locations in the heating unit 13-1 of the far-infrared radiation multi-stage type heating furnace 10 in the manner described above, and the far-infrared radiation multi-stage type heating furnace 10 was used 24 hours a day for one month. The result was that the amount of vertically downward deflection at the longitudinal center of the rectangular tubes 30 was less than 0.2 mm. This demonstrates that the steel sheet for hot stamping 15-1 can be supported at substantially constant positions.

In addition, the difference between the maximum temperature and the minimum temperature between regions of the steel sheet for hot stamping 15-1, which was heated to 900° C., was approximately 7° C. Thus, sufficiently uniform heating of the steel sheet for hot stamping 15-1 is achieved.

Other steel sheet support members than the steel sheet support members 30 to 34 illustrated in FIGS. 7(*a*) to 7(*f*) may be used. Examples of other steel sheet support members that may be used include: a rectangular tube formed by integrating the pins with the rectangular tube 30 in a laterally vertical position or a rectangular bar formed by integrating the pins with the rectangular bar 34 in a laterally vertical position; a rectangular tube having, on its upper surface and lower surface, alternating recesses and projections that are formed by providing cutouts in parts of the upper surface and lower surface of the rectangular tube 30 in a laterally vertical position; a member having, on its upper surface, alternating recesses and projections that are formed by providing cutouts in parts of the upper surface of a member having a channel-shaped cross section in a laterally vertical position; and a rectangular tube having, on its upper surface and lower surface, successive round holes that are formed by providing round holes in the upper surface and lower surface of the rectangular tube 30 in a laterally vertical position.

The present invention significantly minimizes thermal deformation and other damage to the steel sheet support members 30 to 34. As a result, the present invention achieves a significant reduction in the maintenance cost of the far-infrared radiation multi-stage type heating furnace 10, an improvement in capacity utilization of the far-infrared radiation multi-stage type heating furnace 10 and heating uniformity therein; and size reduction of the far-infrared radiation multi-stage type heating furnace 10 by virtue of the multi-stage configuration.

REFERENCE SIGNS LIST

10 far-infrared radiation multi-stage type heating furnace
13-1 to 13-6 heating unit
14-1 to 14-7 far-infrared radiation heater
15-1 to 15-6 steel sheet for hot stamping
16*a* to 16*f* block made of a thermal insulation material
19 ceiling unit
26 first metal strip
27 support piece
30 to 34 steel sheet support member

The invention claimed is:

1. A far-infrared radiation multi-stage type heating furnace for steel sheets for hot stamping, the far-infrared radiation multi-stage type heating furnace comprising:

heating units, each of the heating units comprising:

blocks made of a thermal insulation material, each of the blocks being disposed around a respective horizontal plane of a respective space for accommodating a respective one of the steel sheets for hot stamping;

a far-infrared radiation heater positioned below the respective one of the steel sheets for hot stamping to heat the respective one of the steel sheets for hot stamping, a plurality of first metal strips that receive the far-infrared radiation heater in such a manner that the far-infrared radiation heater is disposed approximately horizontally, the first metal strips being aligned in a first direction and disposed so that a vertical width of each of the first metal strips is greater than a horizontal width of each of the first metal strips in a section orthogonal to a longitudinal direction of each of the first metal strips, and wherein a top surface of one or more of the metal strips is in direct contact with the far-infrared radiation heater; and support pieces configured to support the plurality of first metal strips when the first metal strips expand and contract in a longitudinal direction by thermal expansion or thermal contraction, wherein the respective far-infrared radiation heater of each of the heating units are positioned above and below the respective one of the steel sheets for hot stamping.

2. The far-infrared radiation multi-stage type heating furnace according to claim 1 for steel sheets for hot stamping, wherein the support pieces are positioned outside the blocks in the heating units.

3. The far-infrared radiation multi-stage type heating furnace according to claim 1 for steel sheets for hot stamping, wherein each of the far-infrared radiation heaters comprises a planar structure comprising a plurality of insulator elements arranged in rows, the insulator elements comprising sintered form of far-infrared radiation emitting ceramics, and wherein the plurality of insulator elements are coupled together by a heating wire so as to be capable of being displaced from each other so that the far-infrared radiation heater has flexibility, the heating wire being inserted in heating wire through holes formed in the respective insulator elements.

4. The far-infrared radiation multi-stage type heating furnace according to claim 2 for steel sheets for hot stamping, wherein each of the far-infrared radiation heaters comprises a planar structure comprising a plurality of insulator elements arranged in rows, the insulator elements comprising sintered form of far-infrared radiation emitting ceramics, and wherein the plurality of insulator elements are coupled together by a heating wire so as to be capable of being displaced from each other so that the far-infrared radiation heater has flexibility, the heating wire being inserted in heating wire through holes formed in the respective insulator elements.

5. The far-infrared radiation multi-stage type heating furnace according to claim 1 for steel sheets for hot stamping, wherein the first metal strips comprise a heat resistant alloy.

6. The far-infrared radiation multi-stage type heating furnace according to claim 2 for steel sheets for hot stamping, wherein the first metal strips comprise a heat resistant alloy.

7. The far-infrared radiation multi-stage type heating furnace according to claim 3 for steel sheets for hot stamping, wherein the first metal strips comprise a heat resistant alloy.

8. The far-infrared radiation multi-stage type heating furnace according to claim 4 for steel sheets for hot stamping, wherein the first metal strips comprise a heat resistant alloy.

9. The far-infrared radiation multi-stage type heating furnace according to claim 1 for steel sheets for hot stamping, each of the heating units further comprising an insulating member provided between the first metal strips and the far-infrared radiation heater.

10. The far-infrared radiation multi-stage type heating furnace according to claim 2 for steel sheets for hot stamping, each of the heating units further comprising an insulating member provided between the first metal strips and the far-infrared radiation heater.

11. The far-infrared radiation multi-stage type heating furnace according to claim 3 for steel sheets for hot stamping, each of the heating units further comprising an insulating member provided between the first metal strips and the far-infrared radiation heater.

12. The far-infrared radiation multi-stage type heating furnace according to claim 4 for steel sheets for hot stamping, each of the heating units further comprising an insulating member provided between the first metal strips and the far-infrared radiation heater.

13. The far-infrared radiation multi-stage type heating furnace according to claim 5 for steel sheets for hot stamping, each of the heating units further comprising an insulating member provided between the first metal strips and the far-infrared radiation heater.

14. The far-infrared radiation multi-stage type heating furnace according to claim 6 for steel sheets for hot stamping, each of the heating units further comprising an insulating member provided between the first metal strips and the far-infrared radiation heater.

15. The far-infrared radiation multi-stage type heating furnace according to claim 7 for steel sheets for hot stamping, each of the heating units further comprising an insulating member provided between the first metal strips and the far-infrared radiation heater.

16. The far-infrared radiation multi-stage type heating furnace according to claim 8 for steel sheets for hot stamping, each of the heating units further comprising an insulating member provided between the first metal strips and the far-infrared radiation heater.

17. The far-infrared radiation multi-stage type heating furnace according to claim 1 for steel sheets for hot stamping, the far-infrared radiation multi-stage type heating furnace further comprising:

a plurality of second metal strips that are aligned in a second direction intersecting the first direction to receive the far-infrared radiation heaters, the plurality of second metal strips being disposed so that a strong axis direction thereof approximately corresponds to the direction of gravity, the second metal strips being supported by the plurality of first metal strips in such a manner that the second metal strips are expandable and contractible in a longitudinal direction by thermal expansion or thermal contraction.

* * * * *